United States Patent [19]

Buono

[11] 4,337,586

[45] Jul. 6, 1982

[54] APPARATUS FOR THE HANDLING AND CONDITIONING OF SNOW

[76] Inventor: Joseph Buono, 9797 Bitten Dr., P.O. Box 189, Brighton, Mich. 48116

[21] Appl. No.: 247,493

[22] Filed: Mar. 25, 1981

[51] Int. Cl.[3] ..... E01H 4/00

[52] U.S. Cl. ..... 37/222; 172/145; 172/149; 37/224

[58] Field of Search ..... 37/10, 13, DIG. 3, 117.5; 172/133, 145-146, 149-151, 170-174, 177, 180, 195, 787; 404/96, 122

[56] References Cited

U.S. PATENT DOCUMENTS

| | | | |
|---|---|---|---|
| 2,786,283 | 3/1957 | Bradley | 37/10 |
| 3,348,323 | 10/1967 | Purdy | 37/117.5 |
| 3,448,814 | 6/1969 | Bentley et al. | 172/146 |
| 3,794,122 | 2/1974 | Rohrer | 172/149 X |
| 4,019,268 | 4/1977 | Waterman | 37/10 |
| 4,021,942 | 5/1977 | Purdy | 37/10 |
| 4,056,328 | 11/1977 | Maxey | 37/10 X |
| 4,163,329 | 8/1979 | Neff | 172/149 X |

FOREIGN PATENT DOCUMENTS

| | | | |
|---|---|---|---|
| 954309 | 9/1974 | Canada | 172/149 |

*Primary Examiner*—E. H. Eickholt

*Attorney, Agent, or Firm*—Cullen, Sloman, Cantor, Grauer, Scott & Rutherford

[57] ABSTRACT

A snow grooming apparatus for towing behind a pulling vehicle to handle and condition snow, as an example, on ski slopes or cross country trails. The apparatus includes a scraper and snow collector assembly including a scraper blade and hopper followed by a roller assembly. As the apparatus moves forwardly the blade scrapes or cuts the surface of the snow and confines the cut snow in the hopper. The hopper includes at opposite sides thereof a pair of pivoted floated side panels, the bottom edges of which follow the grade or terrain and help to prevent the cut snow in the hopper from escaping out the sides of the hopper. As the apparatus continues to move forwardly, the cut or powder snow is redeposited almost immediately in low areas of the terrain. Finally the roller assembly moves across the redeposited snow and compacts and conditions the surface for safe recreational purposes.

9 Claims, 5 Drawing Figures

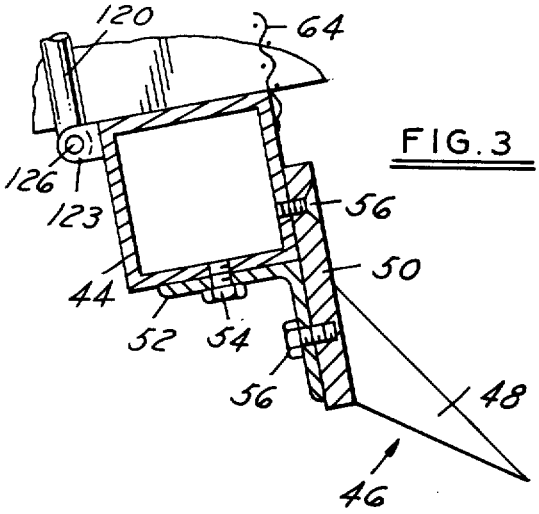
FIG. 3
FIG. 4
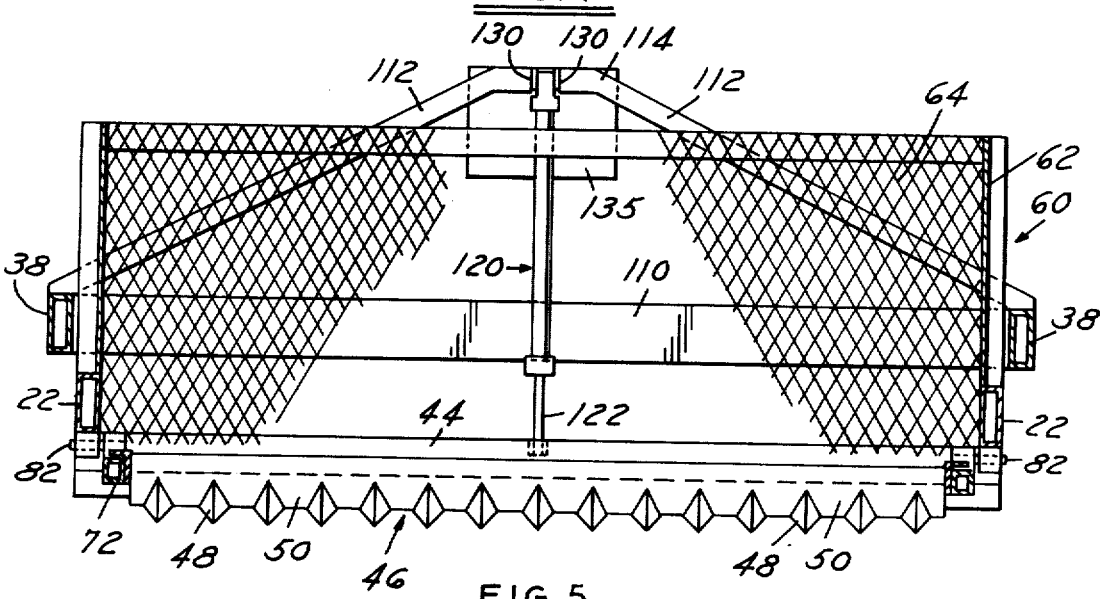
FIG. 5
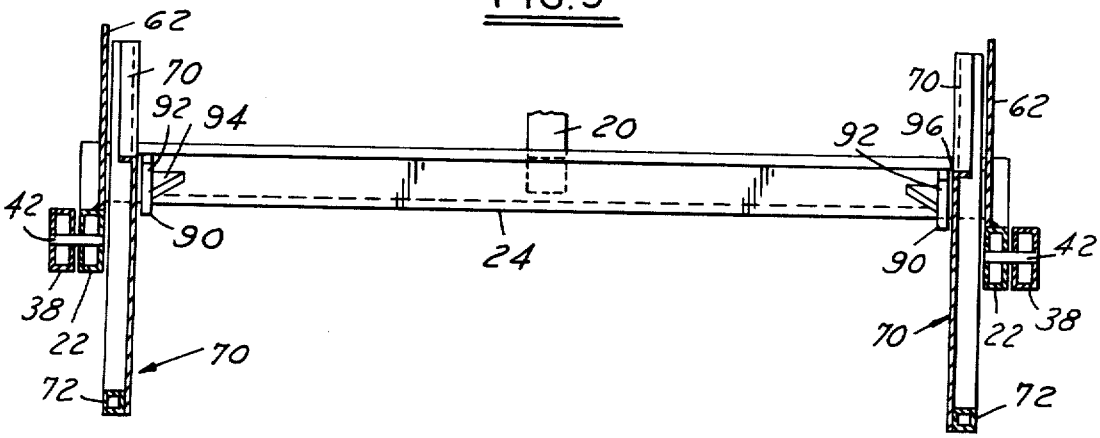

APPARATUS FOR THE HANDLING AND CONDITIONING OF SNOW

BACKGROUND OF THE INVENTION

1. Field of the Invention

This invention relates to improvements in an apparatus for handling and conditioning snow primarily at winter recreational areas. The apparatus is pulled by a tractor, snowmobile or other power source and is designed to cut the bumps, hills and irregular snow surfaces on hills, ski slopes and cross country trails used for snowmobiles and for cross country skiing. The apparatus is also constructed to move the cut or powder snow into the valleys or low spots on non-snow covered or bare areas in order to fill same. Thereafter the apparatus rolls the powder snow to grade. It is an accepted practice to periodically condition the snow on hills or ski slopes or trails; however the equipment generally available for such purpose does not provide the desired and necessary grooming of the snow unless considerable time and effort is spent. Such efforts, however, are not fully satisfactory for ideal skiing and other recreational activities.

2. Description of the Prior Art

The prior art snow handling equipment and machines are illustrated in various U.S. patents including: U.S. Pat. No. 955,590, Grimes, "Machine for Leveling and Rolling Snow on Roads" of Apr. 19, 1910; U.S. Pat. No. 1,796,166, Sharp, "Snow Packing Machine", of Mar. 10, 1931; U.S. Pat. No. 2,140,105, Cluster, "Road Building And Reclamation Machine" of Dec. 13, 1938; U.S. Pat. No. 2,786,283, Bradley, "Apparatus for Grading and Packing Snow" of Mar. 26, 1957; U.S. Pat. No. 3,319,366, Thompson, "Earth Handling Machine" of Mar. 16, 1967; U.S. Pat. No. 3,348,323, Purdy, "Combination Land Leveler" of Oct. 24, 1967; U.S. Pat. No. 3,755,930, "Snow Grader" of Sept. 4, 1973; U.S. Pat. No. 3,889,760, Manor, "Combined Smoother and Roller Packer" of June 17, 1975; U.S. Pat. No. 3,915,239, Hendrichon, "Trail Scraper" of Oct. 28, 1975; and U.S. Pat. No. 4,019,268, Waterman, "Apparatus for Compacting Snow For Skiing" of Apr. 26, 1977.

SUMMARY OF THE INVENTION

The present invention has greatly improved and overcome the inadequacies of the prior art structures and machines and provides an improved apparatus for handling and conditioning snow which enables a single operator to handle and condition the snow to meet requirements for satisfactory skiing conditions and further to accomplish this result in minimal time so that the ski slopes or cross country trails for snowmobile or skiing can be made ready, safe, usable and available to skiers at times most favorable for skiing.

According to the present invention, a snow handling and conditioning apparatus is provided which includes a tongue and hitch assembly at the forward end thereof which is designed to be attached to and pulled by a towing vehicle such as a tractor, snowmobile or other power source. In addition to the tongue and hitch assembly, the apparatus has a roller assembly at the rearward end of the apparatus and a scraper and snow collector assembly intermediate the forward and rearward ends of the apparatus. The assemblies are all connected together and are generally symmetrical about the center line of the apparatus.

A feature of the invention is that the scraper and snow collector assembly has a raised position and a lowered position including a front frame of U-shaped configuration having a pair of laterally spaced apart tubular side members having the forward ends thereof connected by a laterally extending tubular front cross brace. The roller assembly includes a rear elongated frame having a pair of laterally spaced apart tubular side elements having their rearward ends connected by a laterally extending tubular back cross support. The side elements of the rear frame are located outboard of the side members of the front frame. First pivot means are provided connecting the forward ends of the side elements of the rear frame to intermediate portions of the side members of the front frame.

A further feature of the invention is the provision of a scraper blade support mounting element extending parallel to the front cross brace at the back of the front frame which abuts and is secured to the bottom of the tubular side members at the rear end portions thereof. A laterally extending scraper blade is secured to the scraper blade mounting element and is located beneath the front elongated frame. With such a construction the blade comprises a plurality of downwardly inclined teeth for scraping snow or dirt from the terrain when the scraper snow collector assembly is in the lowered position in close proximity to the terrain.

Another feature of the present invention is that the scraper and snow collector assembly includes a hopper open at the top and at the bottom and which is supported by the front frame. The hopper extends forwardly from the scraper blade towards the front cross brace of the front frame to accumulate and collect snow scraped from the terrain by the scraper blade. The hopper includes a pair of solid side walls, one side wall being secured and extending upwardly from each of the side members of the front frame. A transversely extending screen is provided at the back of the hopper, with the screen being located between the solid side walls and extending vertically upwardly from the scraper support element. The purpose of the screen is to permit the cut or powder snow in the hopper to sift through the openings provided in the screen to redeposit quantities of powder snow in low areas of the terrain as the apparatus moves forwardly.

The main feature of the present invention is that the aforesaid hopper has a pair of generally vertically floating side panels on the inboard sides of the side members. Each side panel has a runner or runner portion along the lower edge thereof adapted to engage the terrain or grade, with the rearward and smallest end of each side panel being loosely connected to the corresponding tubular side member of the front frame adjacent the scraper blade. Guide means are spaced from each of the tubular side members and secured to the front cross brace of the front frame. Each guide means extends rearwardly. The front end portion of each floating side panel is received in the space between the corresponding side member and guide means whereby each side panel will move vertically about the loosely connected end as a result of the runner following the terrain or grade. The side panels are generally solid and prevent the snow scraped by the scraper blade from escaping out the sides of the hopper, it being the intended object to have the loose or powder snow sift through the hopper screen as the apparatus moves forwardly.

A further feature of the prevent invention is the provision of the roller assembly which includes a roller having a transversely extending axle, with the ends of the axle being mounted in bearings provided on the side elements of the rear frame. The roller compacts the redeposit quantities of accumulated snow in the low areas of the terrain as the apparatus moves forwardly.

Finally, hydraulic actuating means are interposed between the rear frame and the scraper support on the front frame which is effective when energized to pivot or tilt the front frame about the pivot means so that the scraper blade can be raised or lowered with respect to the terrain. Thus the cutting depth of the scrapper blade is controlled, as an example, at two inches.

With the foregoing snow grooming apparatus, the operator of the tractor or snowmobile can completely condition the snow surface for ideal skiing or snowmobiling or for other winter recreational purposes merely by making a single pass of the towing vehicle across the surface of the snow to be conditioned.

BRIEF DESCRIPTION OF THE DRAWINGS

FIG. 3 is a sectional view through the scraper blade support mounting element and scraper blade taken on the line 3—3 of FIG. 1;

FIG. 4 is a vertical sectional view through the scraper and snow collector assembly taken on the line 4—4 of FIG. 1 and illustrating the back hopper screen and scraper blade; and FIG. 5 is a vertical sectional view taken on the line 5—5 of FIG. 1 and showing the pivot connections between the front and rear frames.

DESCRIPTION OF THE PREFERRED EMBODIMENT

Figure 1:
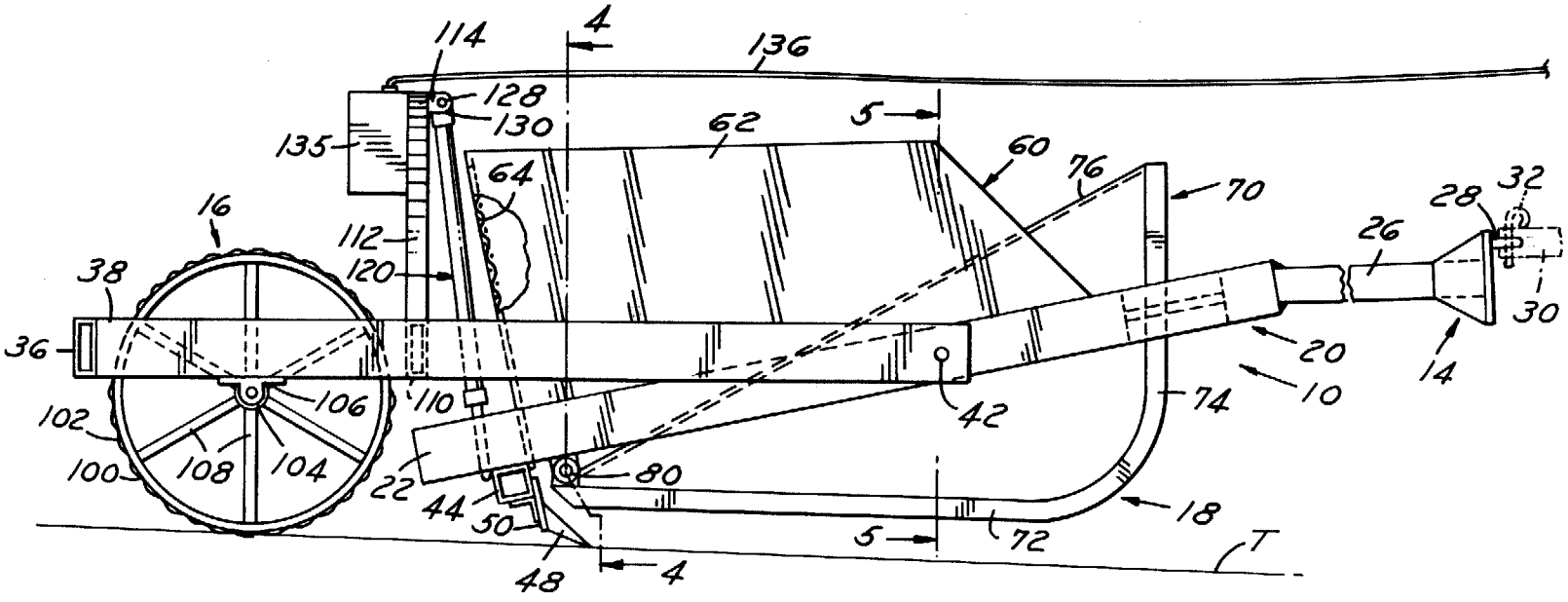
FIG. 1 is a side elevation of the snow grooming apparatus.

Referring now to the drawings, the snow grooming apparatus is designated by the numeral 10 and has a longitudinally extending center line 12. The apparatus 10 is for the handling and conditioning of snow. The apparatus 10 includes three main assemblies including a tongue and hitch assembly 14 at the forward end of the apparatus 10; a roller assembly 16 at the rearward end of the apparatus 10; and a scraper and snow collector assembly 18 intermediate the forward and rearward ends of the apparatus 10.

Figure 2:
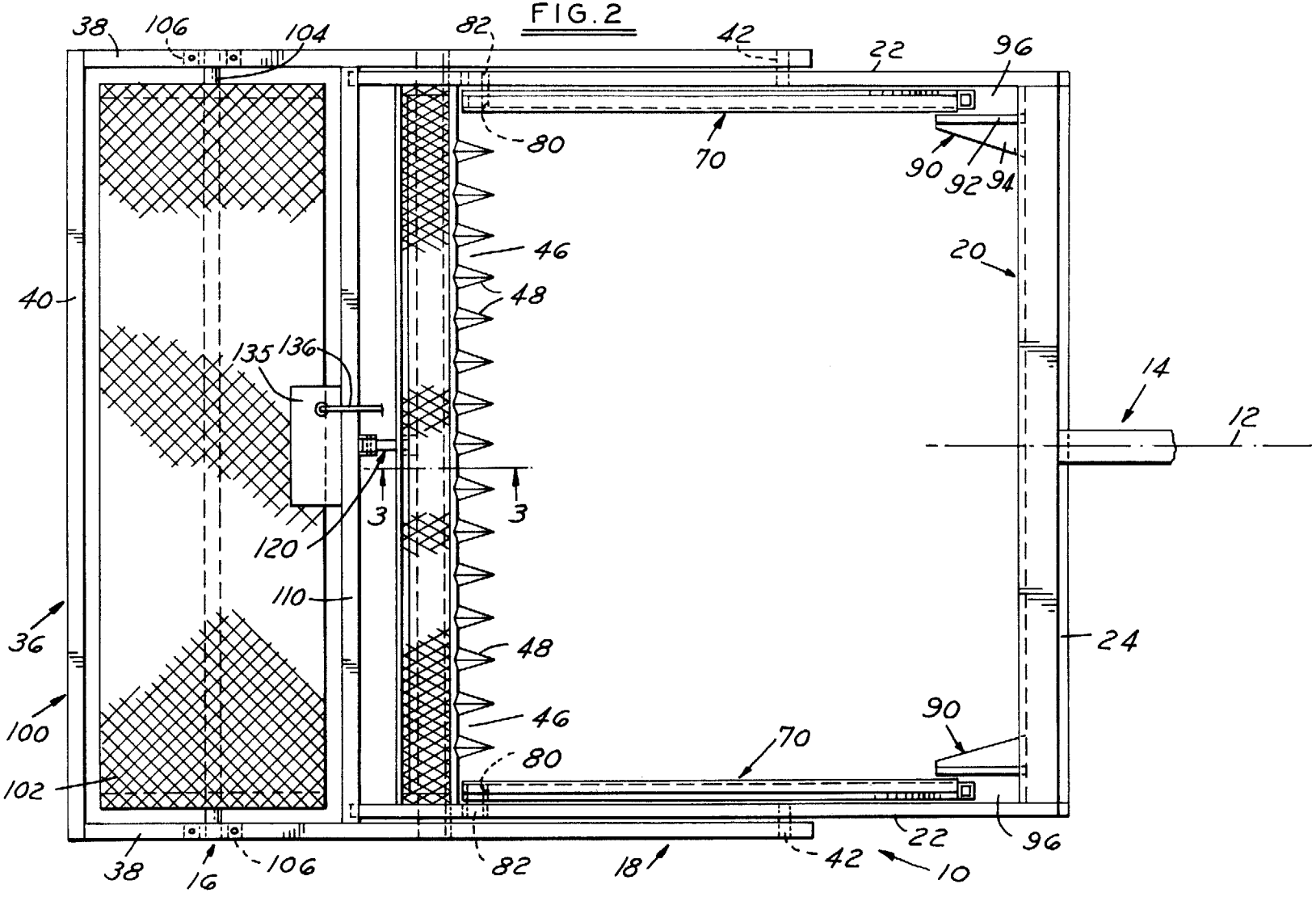
FIG. 2 is a top plan view of the apparatus shown in FIG. 1.

The scraper and snow collector assembly 18 has a raised position and a lowered position including a front elongated frame 20 of U-shape configuration when viewed from the top as best shown in FIG. 2. The frame 20 includes a pair of laterally spaced apart tubular side members 22 of equal length. The side members 22 have the forward ends thereof connected by a laterally extending tubular front cross brace 24. The side members 22 and cross brace 24 are made from steel tubing of generally rectangular configuration. The cross brace 24 is welded to the tubular side members 22.

The tongue and hitch assembly 14 at the forward end of the apparatus 10 includes an elongated tongue 26 located on the center line 12 and having the rearward end thereof welded to the front cross brace 24 as shown in FIG. 1. The tongue 26 has on the leading end thereof a suitable and conventional hitch 28 so that the snow grooming apparatus 10 may be connected to the crow bar 30 provided on the pulling vehicle, not shown. As mentioned previously, the apparatus 10 is designed to be pulled by a tractor, snowmobile or other power source which is capable of traversing ski slopes, cross country trails and other winter recreational snow surfaces. As shown in FIG. 1, the tongue and hitch assembly 14 is connected to the tow bar 30 of the towing vehicle, not shown, by a suitable pin or fastening connection 32 as is well known in the art.

The roller assembly 16 includes a rear elongated frame 36 which is also of generally C-shaped configuration when viewed from the top as illustrated in FIG. 2. The rear frame 36 is of tubular construction and includes a pair of laterally spaced apart tubular side elements 38 having the rearward ends thereof connected by a laterally extending tubular back cross support 40 as shown in FIG. 2. The side elements 38 are welded to the back cross support 40 and are located outboard of the side members 22 of the front frame 20 shown in FIG. 2. The front frame 20 and the rear frame 36 are pivotally connected by a first pivot means 42. The pivots 42 may be in the form of suitable anchor pins or fastening elements which extend through the forward end of the side elements 38 and an intermediate portion of the corresponding side member 22 as best shown in FIG. 2. Such pivots 42 permit the scraper and snow collector assembly 18 to have a raised position and a lowered position where the collector is in close proximity to the grade or terrain as shown in FIG. 1 and as will subsequently be described.

Mounted at the rear of the front frame 20 is a scraper blade support mounting element 44 which extends parallel to the front cross brace 24 at the back of the front frame 20. The mounting element 44 abuts and is secured to the bottom of the tubular side members 22 at the rear portion thereof as best shown in FIG. 1.

A laterally extending scraper blade 46 is secured to the scraper blade mounting element 44. The blade 46 is located beneath the front elongated frame 20 and includes a plurality of downwardly inclined cutting teeth 48 for scraping snow or dirt from the terrain T when the scraper and snow collector assembly 18 is in the lowered position as shown in FIG. 1. The scraper blade 46 may be formed in one unit, with the individual teeth 48 appropriately welded to the mounting portion 15 of the blade 46. The scraper blade support mounting element 44 is also provided with an angle-shaped support 52 which is bolted to the bottom wall of the mounting element 44 by threaded fasteners 54. The blade mounting portion 50 is in turn mounted on the mounting element 44 and angle support 52 by a plurality of fastening devices 56 as best shown in FIG. 3. It is preferred that the scraper blade 46 be made in a plurality of sections so that when one or more teeth 48 break the individual tooth elements may be removed from the mounting element 44 and angle support 52 and in turn replaced with new or re-sharpened replaceable individual tooth elements 48, 50.

The scraper and snow collector assembly 18 further includes a hopper 60 open at the top and at the bottom and at the forward or front end thereof. The hopper 60 is supported by the front frame 20 and extends forwardly from the scraper blade 46 towards the front cross brace 24 to accumulate and collect snow scraped from the terrain T by the scraper blade 46.

The hopper 60 includes a pair of generally solid side walls or panels 62, one side wall 62 being secured and extending upwardly from each of the side members 22 of the front frame 20 as best shown in FIG. 1. The side walls or panels 62 may be welded to the top surface of the side members 22 as best shown in FIG. 5. The hopper 60 further includes a transversely extending screen 64 at the back of the hopper 60. The screw 64 is generally located between the solid side walls or panels 62 and extends vertically upwardly from the scraper support element 44. The screen 64 terminates at the same elevation as do the walls 62 as best shown in FIG. 1.

The screen 64 is secured at the lower end thereof to the scraper blade support mounting element 44 as best illustrated in FIG. 3. The screen 64 permits snow in the hopper 60 to sift through the openings provided therein to redeposit quantities of accumulated snow in low areas of the terrain T as the apparatus moves forwardly.

The hopper 60 includes a pair of generally vertical floating side panels 70, each panel 70 being of a generally right angle configuration as best illustrated in FIG. 1. The side panel 70 has a generally horizontal runner or runner portion 72 which continues into a vertical upstanding portion 74 as shown in FIG. 1. The portions 72 and 74 form two of the three sides of the right angle triangle. The other side or hypotenuse 76 extends from the forward end of the hopper 60 towards the rear end thereof as shown in FIG. 1.

Each floating side panel 70 has only one connection to the front frame 20 and that is a generally loose connection provided between a slotted formation or opening 80 provided in the panel 70 which is adapted to receive a stationary pin or bolt 82 fixedly carried by suitable brackets or tabs provided on the adjacent side member 22 of the front frame 20. It should be appreciated that the bolt or element 82 is fixed. The trailing end of the floating side panel 70 is provided with an elongated slot so that the runner can move upwardly and downwardly in order to follow the grade or terrain T. Thus the slot 80 and bolt or pin 82 forms a connection between the side panel 70 and the adjacent side member 22 of the front frame 20 and such connection is located in close proximity to the scraper blade 46. Each floating side panel 70 is made from a generally solid material, with the runner 72 and upstanding end portion 74 and made from tubular material as best illustrated in FIG. 5.

Each floating side panel 70 has the leading end thereof appropriately guided by means of a guide bar or guide means 90. The guide bar 90 comprises an upstanding plate 92 which is parallel to and spaced inwardly from the side member 22. The member 92 has one end secured to the front cross brace 24 and is reinforced by a reinforcing web 94 which is secured to the plate 92 and to the cross bar or brace 24 as best shown in FIGS. 2 and 5. Each guide means 90 extends rearwardly, with the front end portion of each side panel 70 being received in the vertical space 96 between the corresponding side member 22 and the guide means 90 whereby the side panel 70 will move vertically about the loosely connected or pivoted end (80, 82) as a result of the runner 72 moving along the grade or terrain T. The floating side panels 70 as mentioned previously are generally solid and are specifically provided to prevent snow scraped by the scraper blade 46 and teeth 48 from escaping out the sides of the hopper 60.

The roller assembly 16 further includes a roller 100 of generally large diameter made from corrugated tubing such as the tubing used to form a culver in the road construction field. Thus the outer surface of the drum 100 is grooved. The roller surface 100 has an expanded metal cover 102 having raised surfaces forming diamond shaped openings therein. The purpose of the groove roller 100 and the expanded metal screen or cover 102 is to assist the breaking up of the snow into a fine powder or powdery substance.

The roller 100 is provided with a transversely extending axle 104, with the ends of the axle being mounted in pillow block bearings provided on the lower surfaces of the side elements 38 of the rear frame 36. The roller is designed to compact the redeposited quantities of accumulated snow in the low areas of the terrain T, such snow having been previously placed in front of the roller 100 by the sifting action of the screen 64 of the hopper 60. The roller 100 is provided with a series of spokes 108 for reinforcing the surface 100 and expanded metal cover 102.

The rear frame 36 further includes a second transversely extending cross support 110 of tubular configuration. The ends of the support 10 are welded to the side elements 38 of the rear frame 36. A pair of downwardly diverging braces 112 form part of the rear frame 36 and are located above and spaced from the second cross support 110. The braces 112 have the inner ends thereof connected by a suitable plate or other means 114 near the center of the apparatus 10 at an area located above the top edges of the screen 64 and side wall 62 as best illustrated in FIGS. 1 and 4. The other or lower ends of the downwardly diverging braces 112 are welded to the side elements 38 of the rear frame 36 as shown in FIG. 4.

Hydraulic actuating means 120 as an example, in the form of a hydraulic cylinder and piston device is mounted generally vertically on the rear frame 36. The center line 12 of the apparatus 10 extends through the cylinder 120. The rod end 122 of the hydraulic actuating means 120 is pivotally connected to brackets 123 provided on the upper edge of the back or rear side of the scraper blade mounting element 44 as best illustrated in FIG. 3. The pivot pin 26 connects the rod 122 to the brackets 123. The closed end of the cylinder of the hydraulic actuating means 120 is pivotally connected by a pin connection 128 carried by brackets 130 on the mounting plate or element 114 as best shown in FIGS. 1 and 4. The hydraulic cylinder or actuating means 120 further includes a reservoir or chamber 135 and a hose or cylinder 136 which is adapted to be connected to the hydraulic system of the pulling tractor or other vehicle and controlled by the operator in the tractor. It should be appreciated that the hydraulic cylinder could include an integrated power pack and reservoir for operating same independently of the hydraulic system provided in the tractor or pulling vehicle.

The hydraulic actuating means 120 when energized is effective to pivot or tilt the front frame 20 about the pivot means 42 so that the scraper blade 36 can be raised or lowered with respect to the grade or to the terrain T. Thus the cutting blade 46 may be set to a predetermined depth as controlled by the operator of the vehicle.

The groomer or grooming apparatus 10 features the use of a pair of independently mounted floating side panels 70 which are designed to follow the terrain and grade and to prevent the cut or powdered snow from escaping from the sides of the hopper. With such a construction the snow is collected within the confines of the hopper and is sifted by the screen 64 as the apparatus 10 moves forwardly. Powdered or cut snow fills the cuts and valleys and is thereafter compacted by the roller 100.

The rear and front frames are each made from tubular steel welded construction. The drum or roller 100 utilizes commercially available corrugated tubing which is now used for the construction of road culvers. The expanded cover 102 provided on the roller 100 is also used in industry as a metal flooring. These and other structural functional features set forth in the application assist in rendering versatility to the structure or apparatus which can be used on ski trails, snowmobile trails or on ski slopes. Finally, the apparatus 10 not only cuts the snow but also pulverizes or powders the snow so that the small powdery substance can be sifted through the screen 64 onto the terrain immediately in front of the roller 100. The roller, provided with a suitable metal cover 102, thereafter properly rolls on the surface of the snow without slipping sideways so as to suitably compact and groom the surface of the snow.

I claim:

1. An apparatus for the handling and conditioning of snow and adapted to be pulled by a tractor or other power source comprising:

a tongue and hitch assembly at the forward end of the apparatus and located on the centerline thereof;

a roller assembly at the rearward end of the apparatus; and a scraper and snow collector assembly intermediate the forward and rearward ends;

said scraper and snow collector assembly having a raised position and a lowered position including a front elongated frame of U-shaped configuration when viewed from the top and having a pair of laterally spaced apart tubular side members having the forward ends thereof connected by a laterally extending tubular front cross brace;

said roller assembly including a rear elongated frame having a pair of laterally spaced apart tubular side elements having the rearward ends thereof connected by a laterally extending tubular back cross support;

the side elements of said rear frame being located outboard of the side members of said front frame;

first pivot means connecting the forward ends of said side elements to intermediate portions of said side members;

a scraper blade support mounting element extending parallel to said front cross brace at the back of said front frame and abutting and secured to the bottom of said tubular side members at the rear end portions thereof;

a laterally extending scraper blade secured to said scraper blade mounting element and located beneath said front elongated frame, said blade comprising a plurality of downwardly inclined teeth for scraping snow or dirt from the terrain when the scraper and snow collector assembly is in said lowered position;

said scraper and snow collector assembly further including a hopper open at the top and at the bottom and supported by said front frame, said hopper extending forwardly from said scraper blade towards said front cross brace to accumulate and collect snow scraped from the terrain by said scraper blade;

said hopper including a pair of solid side walls, one side wall being secured and extending upwardly from each of the side members of said front frame, said hopper further including a transversely extending screen at the back of said hopper, said screen being located between said solid side walls and extending vertically upwardly from said scraper support element, said screen permitting snow in said hopper to sift through the openings provided therein to redeposit quantities of accumulated snow in low areas of the terrain as the apparatus moves forwardly;

said hopper further including a pair of generally vertical floating side panels on the inboard sides of said side members, each side panel having a runner portion along the lower edge thereof adapted to engage the terrain, the rearward end of each side panel being loosely connected to the corresponding tubular side member adjacent said scraper blade;

guide means spaced from each tubular side member and secured to the front cross brace, each guide means extending rearwardly, the front end portion of each side panel being received in the space between the corresponding side member and guide means whereby each side panel will move vertically about the loosely connected end as a result of the runner portion moving along the terrain;

said side panels being generally solid and preventing the snow scraped by said scraper blade from escaping out the sides of the hopper;

said roller assembly further including a roller having a transversely extending axle, with the ends of the axle being mounted in bearings provided on the side elements of said rear frame, said roller compacting the redeposit quantities of accumulated snow in the low areas of the terrain;

and hydraulic actuating means interposed between said rear frame and the scraper support on said front frame, which is effective when energized to pivot or tilt said front frame about said pivot means so that said scraper blade can be raised or lowered with respect to the terrain;

said tongue and hitch assembly including an elongated tongue extending forwardly from and secured to said front cross brace.

2. The apparatus defined in claim 1 wherein said vertical floating side panels are of triangular configuration and are constructed to freely follow the terrain or grade.

3. The apparatus defined in claim 1 wherein each of said vertical floating side panels has an elongated slot at the trailing end thereof, each of said side members having a stationary pin or bolt extending through the slot of the corresponding side panel to form the loose connection therebetween.

4. The apparatus defined in claim 1 wherein said front cross brace and said scraper support element are welded to the side members of said front frame; said back cross support is welded to said side elements; and a second tubular cross support extending parallel to said back cross support and having the ends thereof welded to said side elements; said second cross support being located forwardly of said roller; and a pair of downwardly diverging braces forming part of said rear frame and located above and spaced from said second cross support, said braces having the inner ends thereof connected near the center of the apparatus at an area located above the top edges of said screen and side walls, with the other ends of said downwardly diverging braces being welded to said side channels.

5. The apparatus defined in claim 4 wherein said hydraulic actuating means is in the form of a hydraulic cylinder intersecting the center line of the apparatus and having the rod end secured to said scraper support element of said front frame and the cylinder end secured to the inner portions of said diverging braces on said rear frame.

6. The apparatus defined in claim 5 wherein said hydraulic cylinder includes an integrated power pack and reservoir for operating same.

7. The apparatus defined in claim 5 wherein said hydraulic cylinder is adapted to be connected to the hydraulic system of the pulling tractor or other vehicle and controlled by the operator in the tractor.

8. The apparatus defined in claim 1 wherein said roller has a grooved annular surface; said surface being covered by an expanded metal raised diamond shaped annular cover to assist in breaking up the snow into a fine powder or powdery substance.

9. The apparatus defined in claim 1 wherein said scraper blade comprises a plurality of replaceable individual tooth elements mounted side by side along said scraper blade support mounting element by means of threaded fasteners.

* * * * *